United States Patent [19]

Allen et al.

[11] Patent Number: 4,597,924

[45] Date of Patent: Jul. 1, 1986

[54] TETRA-ALKYL TITANATES AS BONDING AGENTS FOR THERMOPLASTIC PROPELLANTS

[75] Inventors: Henry C. Allen, Decatur; Frederick W. Clarke, Huntsville, both of Ala.

[73] Assignee: The United States of America as represented by the Secretary of the Army, Washington, D.C.

[21] Appl. No.: 789,598

[22] Filed: Oct. 21, 1985

[51] Int. Cl.[4] ..... C06B 21/00

[52] U.S. Cl. ..... 264/3.6; 149/19.4; 149/19.91; 149/76

[58] Field of Search ..... 149/76, 19.4, 19.91; 264/3 R, 3 B, 3 C, 3 E, 3.1, 3.3, 3.4, 3.6

[56] References Cited

U.S. PATENT DOCUMENTS

| | | | |
|---|---|---|---|
| 3,894,894 | 7/1975 | Elrick | 149/19.8 |
| 3,907,619 | 9/1975 | Elrick | 149/92 X |
| 4,084,993 | 4/1978 | Cook | 149/41 X |
| 4,430,131 | 2/1984 | Tremblay | 149/76 X |
| 4,486,317 | 12/1984 | Sandell | 149/21 X |

*Primary Examiner*—Peter A. Nelson

*Attorney, Agent, or Firm*—Anthony T. Lane; Robert P. Gibson; Freddie M. Bush

[57] ABSTRACT

A process is disclosed for improving the mechanical properties and processability of thermoplastic composite propellants achieved by incorporation in the propellant of from about 0.1% to 1.0% of an organic titanate of the general formula $Ti(OR)_4$, where R represents a common alkyl group.

The process comprises dissolving in an excess amount of a volatile organic solvent a thermoplastic elastomer which consists of hard segments having substantially crystalline properties and soft segments having substantially amorphous properties. The hard segments impart rigid properties to a solid propellant composition with which it is combined, and the soft segments imparting rubbery properties to a solid propellant composition with which it is combined.

The $Ti(OR)_4$ functions as a medium between the surface of the ammonium perchlorate (AP) oxidizer and the thermoplastic elastomer to improve processability and to provide a bonding substrate to enhance the adhesive bond between the AP and the thermoplastic elastomer. After solvent removal, the propellant pellets are heat formed in a mold, the mold is cooled, and the molded product is released in the form of a solid propellant grain.

2 Claims, No Drawings

TETRA-ALKYL TITANATES AS BONDING AGENTS FOR THERMOPLASTIC PROPELLANTS

DEDICATORY CLAUSE

The invention described herein may be manufactured, used, and licensed by or for the Government for governmental purposes without the payment to us of any royalties thereon.

BACKGROUND OF THE INVENTION

The employment of thermoplastic elastomers as solid rocket propellant binders required a deviation from conventional processing techniques before they became a reality. The earlier approaches to employing thermoplastic elastomers as propellant binders had been centered around using standard state-of-the-art processing techniques; however, artisans, after much experimental work, concluded that it would be impractical, if not impossible, to mix solid particulates at the levels of interest into most thermoplastic elastomers while they are held above their melting points.

After a new conception and a subsequent reduction to practice, the desires of the propellant industry became a reality after being provided the combinations of the conceived process to prepare melt-formable composite rocket propellants. The completed invention offers a new beginning in the propellant industry. The invention which was filed on June 12, 1981, as Patent Application Ser. No. 272,859 issued as U.S. Pat. No. 4,361,526 on Nov. 30, 1982 to Henry C. Allen, and it is assigned to The United States of America as represented by the Secretary of the Army, Washington, D.C.

The invention of thermoplastic composite rocket propellant provides processes for practical formulation and additionally provides processes for reclaiming the propellant ingredients from the finished grain when desired, and thus, in actuality, the invention provides new techniques for the solid propellant artisan to overcome obstacles of the conventional prior art processing techniques. Thus, the advantages for utilizing a wide range of thermoplastic elastomers as solid propellant binders were soon recognized.

The advantages of thermoplastic rocket propellants are described in U.S. Pat. No. 4,361,526, and a practical formulation and process for preparation thereof are taught therein. However, it has become apparent through interpretation of stress versus strain data taken on propellant of the aforementioned formulation that the maximum potential with respect to mechanical properties for this type of propellant had not been achieved because of poor bonding of the thermoplastic binder to the oxidizer particles.

It is well known in the art that many propellant binders adhere poorly to the most commonly used composite propellant oxidizer, ammonium perchlorate (AP), and consequently it is common practice in the art to include in certain composite propellants small quantities of materials known as bonding agents to enhance the adhesive bond between the binder and AP. More detailed teaching on the use of bonding agents in composite propellants is to be found in the patent literature, for example in U.S. Pat. Nos. 3,745,074 and 3,762,972. It was because of this prior art teaching that the above mentioned formulation included as an intended bonding agent HX752, a well-known bonding agent for propellants having hydroxyterminated polybutadiene (HTPB) as binder. It has now been found that HX752 as well as other conventional bonding agents for chemically cured composite propellants have only minimal effect on the mechanical properties of thermoplastic composite propellants. Such conventional bonding agents depend on the agent's ability to form an adhesive coat on the oxidizer particles on the one hand and to chemically bond to the binder polymer during the propellant cure process on the other. Thermoplastic elastomers of the styrene-diene block copolymer type do not contain sites which are chemically reactive with conventional bonding agents, and thus no chemical bonding between binder and bonding agent can occur.

Conventional bonding agents for chemically cured AP-oxidized composite propellants do not form chemical bonds with the AP particles. This is true of even those nominal bonding agents which contain amine groups in their structures which chemically react with the AP particles to form amine perchlorates and liberate ammonia according to the following reaction:

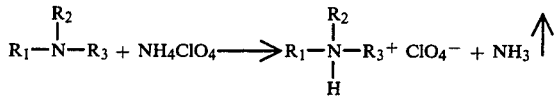

where $R_1$, $R_2$ and $R_3$ comprise a combination of hydrogen and various organic groups such as have been found useful in certain bonding agents. The amine perchlorates, which are the true bonding agents in this illustration, are formed in situ on the AP particle surfaces and adhere to those surfaces through electrical rather than chemical forces. Sites for chemical reaction with the binder are usually derived from one or more of the groups $R_1$, $R_2$ and $R_3$. The main point is that the nominal bonding agent is not chemically bound to the AP particles, but rather that it consumes a part of the AP via chemical reaction to form the true bonding agent, a separate chemical entity that merely adheres to the underlying AP surface through electrical attraction. This has been shown by Ducote and Allen in U.S. Pat. No. 4,491,741 wherein the perchlorate salts of the amine-type nominal bonding agents known in the art as TEPAN and TEPANOL were previously prepared by chemical reaction apart from the propellant mix and then added to the mix as bonding agents, the results being that propellant mechanical properties were indistinguishable from those in which the nominal bonding agents were added to the mix. Other bonding agents likewise adhere to AP particles by non-chemical bonding forces since they do not chemically react with AP. Thus it is shown that strong adhesion to AP particles is possible without chemical bonding thereto, and indeed that essentially all bonding agents for AP-oxidized propellant adhere to AP without chemical bonding thereto.

We now examine the matter of bonding between a bonding agent and a propellant binder. Since it is quite easy to synthesize bonding agents with chemical groups which can participate in propellant cure reactions, and since such reactions produce a very strong chemical bond between propellant binder and bonding agent, there has been no incentive to discover bonding agents for chemically cured propellants which do not chemically react with the propellant binder. However, incidental to other studies, it has been found and is well known in the art that propellant binders sometimes bond strongly to various types of solid particles with which there is no chemical reaction. Examples may be found in the bonding of hydrocarbon propellant binders to aluminum, aluminum oxide, carbon and various other types of particles. Thus chemical bonding between a polymer (propellant binder) and a substrate (particle) surface is not a requirement for a strong bond provided that the substrate surface has suitable characteristics relative to the bonding requirements of the polymer, as is well documented in the classicial adhesion literature and is mentioned here only to complete the argument summarized in the following paragraph.

Since chemical bonding to AP particles does not occur in conventional AP-oxidized propellants, and since chemical bonding is not required for a propellant binder to bond strongly to certain types of particle surfaces, it should be possible to modify the surfaces of AP particles so that chemically unreactive thermoplastic elastomers will bond strongly thereto and thus greatly improve the mechanical properties of the resulting propellant. Such modification may consist of the deposition onto the AP particle surfaces of a thin film of a material which will both adhere strongly to the AP surfaces and provide the substrate characteristics to which thermoplastic elastomers of the styrene-diene block copolymer type will adhere strongly. This invention accomplishes such a modification.

Therefore, it is an object of this invention to provide a class of bonding agents for thermoplastic composite propellants which does not require chemical reaction with the binder in order to be highly effective in improving the mechanical properties thereof. It will be shown in the discussion below that this object is theoretically attainable, and data will be presented to show that the object has been attained in practice.

A further object of this invention is to provide the teaching directed toward the theoretical basis for a proposed mechanism of how the improved mechanical properties are achieved for thermoplastic composite propellants by employing a new class of bonding agents.

Still a further object of this invention is to provide formulations employing a new class of bonding agent to illustrate in a reduction to practice the improved mechanical properties resulting from the use of a new class of bonding agent for thermoplastic composite propellants.

SUMMARY OF THE INVENTION

Organic titanium compounds of the general formula $Ti(OR)_4$, such compounds being commonly referred to as titanate esters or simply titanates, where R is an alkyl group, when added in amounts from about 0.1% to about 1.0% weight percent to thermoplastic propellants in which a styrene-diene block copolymer comprises the binder base and ammonium perchlorate comprises the principal oxidizer, greatly improve the mechanical properties of such propellants. The improvement is attributed to increased bonding between the binder and AP due to deposition on AP particle surfaces of titanium compounds resulting from chemical reaction of the added titanate with incidental water on the AP particles.

A control thermoplastic propellant is formulated as follows: about 12.0 parts of Kraton 1107, a styrene-diene block copolymer manufactured by Shell Chemical Company, is dissolved in about 15.0 parts of cyclohexane, and then 0.5 parts of dioctylphthalate and about 7.5 parts of naphthenic oil are added. The resulting solution is transferred to a bowl of a mechanical propellant mixer, where about 80 parts of ammonium perchlorate (AP) blend (28.0 parts 17 μm AP and 52.0 parts 200 μm AP) is added and incorporated by mixing to a homogenous slurry. The mixer is then vented and heated until the mixture thickens to a thick paste due to evaporation of cyclohexane. The paste is spread on a sheet of plastic and vacuum dried for one hour at 60° C. and 1 mm pressure. The dried propellant is cut into pieces suitable for molding. Tensile test specimens are molded by compressing the propellant in a mold at 130° C.; upon cooling the mold, a specimen suitable for tensile testing is obtained. The experimental propellant sample is made by reducing the Kraton 1107 by about 0.5 parts and adding about 0.5 parts of tetrabutyl titanate in its place.

DESCRIPTION OF THE PREFERRED EMBODIMENT

An organic titanium compound of the general formula $Ti(OR)_4$, a titanate ester or titanate, where R is an alkyl group, when added in amounts from about 0.1% to about 1.0% by weight percent to thermoplastic propellants, functions as a bonding agent in propellants in which a styrene-diene block copolymer comprises the binder base and ammonium perchlorate comprises the principal oxidizer, greatly improving the mechanical properties of such propellants.

Table I below sets forth thermoplastic propellant formulation used to evaluate the titanate ester bonding agent of this invention.

TABLE I

THERMOPLASTIC PROPELLANT FORMULATION USED TO EVALUATE TITANATE ESTER BONDING AGENT

| INGREDIENT | | FUNCTION |
|---|---|---|
| 0.5% | Dioctylphthalate | Plasticizer |
| 7.5% | Naphthenic Oil | Plasticizer |
| 11.5–12.0% | Styrene-diene Block Copolymer | Thermoplastic Binder |
| 28.0% | 17 μm $NH_4C10_4$ | Oxidizer |
| 52.0% | 200 μm $NH_4C10_4$ | Oxidizer |
| 0.0–0.5% | Tetraalkyl Titanate | Bonding Agent |

Propellants are processed according to the following procedure.

The thermoplastic elastomer and other binder ingredients such as plasticizers are first dissolved in a suitable non-polar solvent such as n-hexane, cyclohexane, or toluene. The solution is then transferred to a mechanical propellant mixer where the solid ingredients are added and incorporated by mixing until a homogeneous slurry is obtained. The operating mixer is then vented and heated to about 70° C. to hasten evaporation of the solvent. Typically the propellant is removed from the mixer when it is a very thick paste containing about 3–5% solvent, spread on a plastic sheet and dried in air or a vacuum oven. Alternatively, the propellant can be mixed to complete dryness in the operating mixer, in which case the action of the mixer blades produced a fine crumb form of the propellant which was directly suitable for use in final melt forming; however, this procedure is substantially more hazardous than performing final drying outside the mixer.

Samples of propellant for testing are formed by filling suitable molds with propellant crumb and cut pieces, heating under vacuum to soften the propellant without causing oxidation of the binder and air entrapment in the sample, and compressing the sample in the mold with a piston while the sample temperature is above the softening point of the thermoplastic binder. The mold is then cooled and the sample removed for testing.

The advantages of the invention are shown in the following example: (all parts by weight)

12.0 parts of Kraton 1107, a styrene-diene block copolymer comprised of about 5 to about 20 weight percent styrene and of about 80 to about 95 weight percent diene manufactured by Shell Chemical Company, is dissolved in 15.0 parts of cyclohexane, and then 0.5 parts of dioctylphthalate and 7.5 parts of naphthenic oil are added. This solution is transferred to the bowl of a mechanical propellant mixer, where 80 parts of AP as shown in Table I are added and incorporated by mixing to a homogeneous slurry. The mixer is then vented and heated until the mixture thickened to a thick paste due to evaporation of cyclohexane. The paste is spread on a sheet of plastic and vacuum dried for one hour at 60° C. and 1 mm pressure. The dried propellant is cut into pieces suitable for molding. Tensile test specimens are molded by compressing the propellant in a mold at 130° C. Upon cooling the mold a specimen suitable for tensile testing is obtained.

A second mix is made exactly as described above except that the quantity of Kraton 1107 is reduced by 0.5 part, and 0.5 part of tetrabutyl titanate is added in its place. Tensile test samples were molded from this mix also, and unexpectedly it was found that the propellant possessed much better molding properties than the mix without titanate. Samples of both mixes were tested for mechanical properties at three temperatures. The data from these tests are shown in Table II along with the molding conditions required to form defect-free specimens.

TABLE II

STRESS-STRAIN DATA OBTAINED AT THREE DIFFERENT TEMPERATURES FOR THERMOPLASTIC PROPELLANTS WITH AND WITHOUT TITANATE ESTER BONDING AGENT. Also included are Sample Molding Temperatures and Pressures

| Mix No. | Bonding Agent | Molding Temp and Pressure | Test Temp. °C. (°F.) | Average Modulus MPa (PSI) | Average Max Stress kPa (PSI) | Average % Strain at Max Stress |
|---|---|---|---|---|---|---|
| 2 | TBT* | 125° C./45 kPa (6.2 psi) | 23 (77) | 5.85 (848) | 737 (106.9) | 27.5 |
| 1 | None | 130° C./208 kPa (30.2 psi) | | 10.46 (1517) | 317 (46.0) | 2.8 |
| 2 | TBT | | 60 (140) | 3.62 (525) | 316 (45.8) | 25.0 |
| 1 | None | | | 10.11 (1466) | 261 (37.8) | 5.1 |
| 2 | TBT | | −40 (−40) | 13.27 (1925) | 1647 (238.9) | 61.4 |
| 1 | None | | | ** | 987 (143.2) | 4.6 |

*Tetrabutyl titanate
**Extreme data scatter, no reliable value obtained

Having described the preferred embodiment and the stress-strain data obtained therefrom, applicants are disclosing additional information below which should provide a better understanding of possible mechanisms of how the unexpected results are achieved by using the titanates as bonding agents for thermoplastic propellant compositions.

Organic titanates have been employed as adhesion promoters between diverse materials in various applications. However, it was not until after experimentation following the conception for using organic titanates as a class of compounds which showed contributing functions as a bonding agent that additional technical explanations are offered for consideration of how or why this class of compounds performs the desired functions. Although knowing the reason why or the mechanisms for the obtaining desired functions are not necessarily required to establish patentability, the following should be of interest to furthering the teachings in this field.

It is well known that many particulate materials contain small amounts of water associated with the particle surfaces as a very thin film which is not removed except by the most stringent drying procedures. It is generally accepted that ammonium perchlorate particles usually have such a film of water on them, even though the total water content of a sample of the salt may be 0.01% or less. It is probably because of this film of water that titanates act as bonding agents for AP in thermoplastic propellant binders, due to reaction of the titanates with water on the particle surfaces, as discussed below. The titanate reacts with the film of water on AP particle surfaces to deposit a coating of titanium compound on the AP surface and provides an excellent bonding substrate for the thermoplastic elastomer.

In the presence of sufficient water, tetraalkyl titanates react to form amorphous titanium dioxide:

$$Ti(OR)_4+2H_2O \rightarrow TiO_2+4ROH.$$

However, lesser amounts of available water result in intermediate products. First the hexa-alkoxy compound (I) is formed:

$$Ti(OR)_4+H_2O \rightarrow Ti(OR)_3\,OH+ROH$$

$$Ti(OR)_3\,OH+Ti(OR)_4 \rightarrow (RO)_3TiOTi(OR)_3+ROH \qquad (I)$$

Reaction of (I) with additional water forms higher molecular weight compounds containing $[Ti(OR)_2O]$ as a repeating segment:

$$2(RO)_3\,TiOTi(OR)_3+H_2O\ RO\,[Ti(OR)_2O]_4R+2ROH$$

or, more generally, $$n\,(RO)_3TiOTi(OR)_3+n/2H_2O\ RO[Ti(OR)_2O]_{2n}R+nROH \qquad (II)$$

In the presence of yet more water (II) yields products containing [Ti(OH)(OR)O], which can react internally to produce $TiO_2$ plus ROH. Thus it is apparent that the compounds of titanium which comprise the actual bonding substrate in this invention may be a complex mixture of the various reaction products of tetraalkyl titanates with water. It is further apparent that this complex mixture of products will vary in its chemical character according to the amount of water available to react with the titanate.

In view of the above discussion it is apparent that an anhydrous propellant would not provide a suitable medium for titanates to perform satisfactorily as bonding agents. Because of this inherent need, it is fortunate that composite propellant ingredients are not normally anhydrous, and propellant mixtures typically contain from 0.005% to 0.03% of water. These amounts of water would be sufficient to convert 0.094% to 0.567% of titanate in a propellant to compound II, or half of these quantities to $TiO_2$, when R in $Ti(OR)_4$ is butyl, since the weight/mole ratio of tetrabutyl titanate/water is 18.89. Thus it is seen that composite propellants typically contain enough water to adequately convert titanate esters to effective bonding substrates when such titanate esters are added to the propellant in amounts typical of propellant bonding agents, i.e., from 0.1% to 1.0% of the propellant by weight. Furthermore, additional water could easily be added to the propellant if the incidental water were insufficient.

Experimentation with titanates having a variety of alkyl radicals represented by R in the general formula $Ti(OR)_4$ has shown that the chemical structure of R is not critical to the effective functioning of the titanate as a bonding agent in thermoplastic propellants. This is not surprising when one considers that R becomes an innocuous by-product of the reaction that produces the desired effect. Thus there are no specific limitations on the nature of the alkyl group represented by R.

The thermoplastic composite rocket propellant (excluding the aziridine compound added as a bonding agent to the dissolved thermoplastic elastomer) which is disclosed in U.S. Pat. No. 4,361,526 issued to Henry C. Allen on Nov. 30, 1982 is suitable for use with the titanates of this invention. In processing this propellant the titanates are added and mixed in the dissolved thermoplastic elastomer in place of the aziridine compound. The discovery as disclosed herein further enhances the usefulness of a thermoplastic composite rocket propellant by the improved mechanical properties and the improved processability achieved by using the organic titanate which functions as a bonding substrate between the ammonium perchlorate and the thermoplastic elastomer binder.

We claim:

1. In a process for utilizing a thermoplastic elastomer as a binder for a composite propellant composition and for forming a solid propellant grain of same, the process including the providing of a thermoplastic elastomer which consists of hard segments having substantially crystal line properties and soft segments having substantially amorphous properties, said hard segments imparting rigid properties to a solid propellant composition with which it is combined, and said soft segments imparting rubbery properties to a solid propellant composition with which it is combined; and dissolving said thermoplastic elastomer in an excess amount of a volatile organic solvent, the improvement in the processability and the mechanical properties of the formed solid composite propellant grain achieved by the improved process which comprises:

(i) adding and mixing an organic titanate bonding agent additive of the general formula $Ti(OR)_4$, where R is selected from the group of alkyl radicals, in an amount from about 0.1 weight percent to about 1.0 weight percent in said dissolved thermoplastic elastomer to react with the film of water on particle surfaces of subsequently added ammonium perchlorate and to deposit a coating of said organic titanate bonding agent additive on said ammonium perchlorate particle surfaces to thereby serve to improve processability and to provide a bonding substrate for said thermoplastic elastomer and to thereby enhance the adhesive bond between said ammonium perchlorate and said thermoplastic elastomer; and, (ii) continue adding and mixing into said dissolved thermoplastic elastomer, propellant solids including aluminum powder as a fuel element and two different nominal particle sizes of ammonium perchlorate, as oxidizer to increase particle packing efficiency, said ammonium perchlorate having a small amount of water in the form of a very thin film on the particles surfaces;

(iii) continue mixing said solids in said thermoplastic elastomer solution to achieve a uniform mixture of said composite propellant composition;

(iv) evaporating said organic solvent from said composite propellant composition to yield a dry solid composite propellant composition free from said volatile organic solvent;

(v) chopping said dried solid composite propellant composition into pellets;

(vi) placing a predetermined amount of said pellets in a mold and heating to 130° C. to yield a viscous fluid of said solid composite propellant composition;

(vii) pressing said viscous fluid in said mold; and, (viii) cooling said mold and releasing from said mold a formed solid composite propellant grain.

2. The process of claim 1 wherein said volatile organic solvent is selected from the non-polar solvents consisting of n-hexane, cyclohexane, and toluene; said thermoplastic elastomer is a block copolymer of styrene and a diene, said styrene comprising from about 5 weight percent to about 20 weight percent of said thermoplastic copolymer with balance weight percent of said thermoplastic elastomer comprised of said diene; and wherein said organic titanate is tetrabutyl titanate.

* * * * *